US012420334B2

(12) United States Patent
Han

(10) Patent No.: US 12,420,334 B2
(45) Date of Patent: Sep. 23, 2025

(54) ULTRASOUND ASSISTED VERTICAL SHOT CHAMBER FOR DIE CASTING APPLICATIONS

(71) Applicant: Qingyou Han, Stow, OH (US)

(72) Inventor: Qingyou Han, Stow, OH (US)

( * ) Notice: Subject to any disclaimer, the term of this patent is extended or adjusted under 35 U.S.C. 154(b) by 0 days.

(21) Appl. No.: 18/757,435

(22) Filed: Jun. 27, 2024

(65) Prior Publication Data

US 2024/0351097 A1 Oct. 24, 2024

Related U.S. Application Data

(62) Division of application No. 16/992,270, filed on Aug. 13, 2020, now Pat. No. 12,048,962.

(51) Int. Cl.

| | |
|---|---|
| ***B22D 17/00*** | (2006.01) |
| ***B22D 17/20*** | (2006.01) |
| ***B22D 17/22*** | (2006.01) |
| ***B22D 27/08*** | (2006.01) |

(52) U.S. Cl.

CPC ..... *B22D 27/08* (2013.01); *B22D 17/007* (2013.01); *B22D 17/2015* (2013.01); *B22D 17/2084* (2013.01); *B22D 17/2272* (2013.01)

(58) Field of Classification Search

USPC ..... 164/900

See application file for complete search history.

(56) References Cited

U.S. PATENT DOCUMENTS

2004/0055726 A1* 3/2004 Hong ..... B22D 17/007 164/113

2015/0343526 A1* 12/2015 Jelbert ..... B22D 17/203 164/71.1

FOREIGN PATENT DOCUMENTS

JP S60250866 A * 12/1985

* cited by examiner

*Primary Examiner* — Kevin E Yoon

(57) ABSTRACT

A method and apparatus for producing semi-solid material castings from its liquid state in a shot chamber of a vertical die casting machine where the liquid material is poured into a shot chamber and rapidly cooled from its liquid state to temperatures below its liquidus. High-intensity ultrasonic vibration is applied to the cast material. The combined action of rapid cooling from the shot chamber, vigorous pushing by the plunger, and radiation of ultrasonic vibration on the cast material in the shot chamber directly turns the initial liquid material directly into a semi-solid slurry. The slurry is then injected into a die cavity to form a casting.

6 Claims, 8 Drawing Sheets

ULTRASOUND ASSISTED VERTICAL SHOT CHAMBER FOR DIE CASTING APPLICATIONS

CROSS-REFERENCE TO RELATED APPLICATIONS

The present U.S. patent application is a divisional application of U.S. patent application Ser. No. 16/992,270 filed Aug. 13, 2020. The relevant contents of this prior application are hereby incorporated by reference into the present disclosure.

FIELD OF THE INVENTION

The present invention relates to industrial metal forming, more specifically, an apparatus and process for forming metal components from non-dendritic, semi-solid metal slurries in a vertical shot chamber used in a die casting process.

BACKGROUND OF THE INVENTION

Die casting, also termed as high pressure die casting (HPDC), is a widely-used metal casting process that is characterized by forcing molten metal under high pressure into a die cavity. The metal, commonly aluminum, magnesium, zinc, and their alloys, and sometimes copper, titanium, and their alloys, is transported into a chamber containing a cylindrical channel connected to the mold cavity and then is injected with a reciprocating cylinder referred to as a plunger into the die cavity where it solidifies and forms a solid component. Die casting is generally considered to be a cost-effective process capable of producing precision (net-shape) products at high production rates. Currently, die casting processes are used to produce over 70% of the annual tonnage of all aluminum castings in the United States.

There are two kinds of die casting processes: hot-chamber and cold-chamber die casting. The hot-chamber die casting process uses "gooseneck" as the chamber containing a cylindrical channel connected to the die cavity. Part of the gooseneck is submerged into the molten metal in a pot or a holding furnace so the chamber is hot. A reciprocating plunger in the cylindrical channel draws the molten metal in and injects it into the mold cavity through a nozzle. A sprue-spreader, located near the exit of the nozzle, prevents molten metal in the die cavity from being sucked back into the gooseneck. The injection system for hot-chamber die casting consists of a gooseneck, plunger, nozzle, and arguably a sprue-spreader.

The cold-chamber process involves pouring hot metal into a cold shot chamber or shot sleeve containing a cylindrical channel and injecting it using a reciprocating plunger into the die cavity. Sometime, a water-cooled shot plate is placed at the exit of the shot sleeve to cool down the hot shot biscuit. The injection system for cold-chamber die casting consists of a plunger or ram, shot sleeve, and shot plate.

The casting equipment and the metal dies represent large capital costs. The tooling for the HPDC process is fairly expensive, thus, increasing tooling life leads to reduced costs for this process. Tooling damage is usually associated with die soldering and heat checking. The tendencies of die soldering and heat checking increase with increasing temperatures so that tooling life is strongly affected by the pouring temperature of the molten alloy [1]. The lower the pouring temperature, the longer the tooling life. Unfortunately, the pouring temperature has to be significantly higher than the liquidus of the alloy. This is because after being poured into the steel shot sleeve, the molten cools quickly to below its liquidus to form primary tree-like crystals called dendrites from the liquid within the massive shot sleeve. Recently, the inventor of this present invention has found that slurry containing these tree-like dendrites can choke the mold filling near the in-gate in the runner/gating system before the dies are completely filled [2]. In adequate fluidity of the alloy leads to the formation of casting defects such as misruns, cold shuts, folds, flow marks, and etc. The only way to lower the pouring temperature of the molten metal is to produce a slurry containing non-dendritic crystals. Semi-solid materials having non-dendritic or spherical primary particles are known to be castable at temperatures much lower than the liquidus using the HPDC process [3]. The fraction solid in the semi-solid material during mold filling is in the range of about 0.3 to about 0.5 with the remainder being the liquid phase.

Methods for producing semisolid materials are described in U.S. Pat. No. 3,948,650 to Flemings et al. and U.S. Pat. No. 3,954,455 to Flemings et al. As disclosed by these patents, a metal alloy in the semi-solid state can be vigorously agitated to break up dendrites into spherical particles. Slurries made in such a way can then feed into the shot sleeve of a die casting machine for making a casting. The benefits of semisolid materials having non-dendritic or spherical primary particles include improved mold filling, lower mold erosion, no die soldering, and thus increased die life and shot tooling life. Other advantages of the semisolid process include less shrinkage during solidification, less porosity in the casting, and more uniform mechanical property. Because of these advantages, several techniques have been developed to produce semisolid materials by applying agitation during solidification, including mechanical stirring, electromagnetic stirring, and ultrasonic vibrations. These techniques utilize different media or means to achieve agitation at the semi-solid state of an alloy before transferring the semi-solid slurry into the shot chamber of a die casting machine for making components [U.S. Pat. Nos. 5,114,998, 5,865,240, 5,901,78, 6,645,323, and European Pat. Appl. No. 96,108,499]. Methods capable of a direct formation of non-dendritic crystals in the shot chamber of a die casting machine are certainly more cost-effective and easier to utilize.

When molten metal is poured into the shot chamber, the molten metal cools down rapidly due to the massive shot chamber so dendritic solidification of the molten metal starts immediately. U.S. Pat. No. 5,579,825 to Shibata et al. and U.S. Pat. No. 10,448,103 by Hong et al. disclose a method of utilizing coils outside the shot chamber to produce electromagnetic stirring in the molten metal to break up dendrites into fragments and to enhance ripening of the fragments into non-dendritic particles. However, one issue is that the external electromagnetic field produces eddy currents both in the molten metal as well as in the steel of the massive shot sleeve. The eddy currents heat up the molten metal and the shot tool steel, leading to decreased tooling life.

Therefore, there is a need to develop an improved method that is capable of using the rapid cooling capability of the shot chamber to produce solid non-dendritic crystals from the molten metal that is poured into the shot chamber. The semi-solid slurry produced in-situ in the shot chamber is then injected into the mold cavity for producing castings of high internal integrity at high production rates and low costs.

SUMMARY OF THE INVENTION

The present invention relates to a method and apparatus for producing a slurry of an alloy containing non-dendritic primary phase solid particles in a shot chamber during die casting for making solid components. In this method, a molten metallic alloy is prepared in a melt holding vessel. The molten alloy is then transferred into the shot chamber of a die casting machine. High-intensity ultrasonic vibration is coupled directly into the molten metal in the shot chamber, breaking up dendrites that form in the shot chamber into non-dendritic solid particles and forming a semi-solid slurry to be injected into the mold cavity for the production of solid components.

In another embodiment, the present invention relates to a method and apparatus for producing a slurry of an alloy containing non-dendritic primary phase solid particles in a shot chamber, wherein the first vessel containing the molten metal is a holding furnace and the second vessel is the shot chamber used for the die casting process. The method involves preparing molten metal using the first vessel, cooling the molten metal rapidly in the second vessel, and forcing the molten metal to flow using the plunger. High-intensity ultrasonic vibration is applied directly to the molten metal through a plurality of sonotrodes embedded in the shot sleeve. The combined action of rapid cooling by the second vessel and vigorous stirring by the plunger and sonotrodes on the molten metal turns dendrites into non-dendritic fragments. As a result, the molten metal can be poured into the second vessel at much lower temperatures than those during a conventional HPDC process which is beneficial in improving the castability of the alloy, extending die and shot tooling life, and reducing porosity in the final casting components.

In yet another embodiment, the invention relates to a method and apparatus for producing a slurry of an alloy containing non-dendritic primary phase solid particles in a shot chamber wherein the water-cooled plunger and/or the shot plate are coupled with high-intensity ultrasonic vibration. High-intensity ultrasonic vibration is transmitted from the tip of a sonotrode embedded in the plunger and/or the shot plate to the semi-solid slurry formed in the shot chamber as the plunger pushes the slurry towards the mold cavity. Vigorous convection in the slurry pushed by the plunger coupled with ultrasonic vibration breaks up dendrites and smooth out the dendritic fragments into spherical solid particles, which is beneficial in improving the castability of the alloy, extending die and shot tooling life, and reducing porosity in the final casting components.

In still another embodiment, the invention relates to a method and apparatus for producing a slurry of an alloy containing non-dendritic primary phase solid particles in the gooseneck and nozzle of a hot chamber die casting process where the sprue-spreader is coupled with high-intensity ultrasonic vibration. A partially solidified material is forced in the gooseneck to pass the ultrasound coupled sprue-spreader which breaks up dendrites in the partially solidified material and forms a slurry containing non-dendritic fragments of dendrites.

Various objects and advantages of this invention will become apparent to those skilled in the art from the following detailed description of the preferred embodiments, when read in light of the accompanying drawings, specification, and claims.

DETAILED DESCRIPTION OF THE INVENTION

Figure 1:
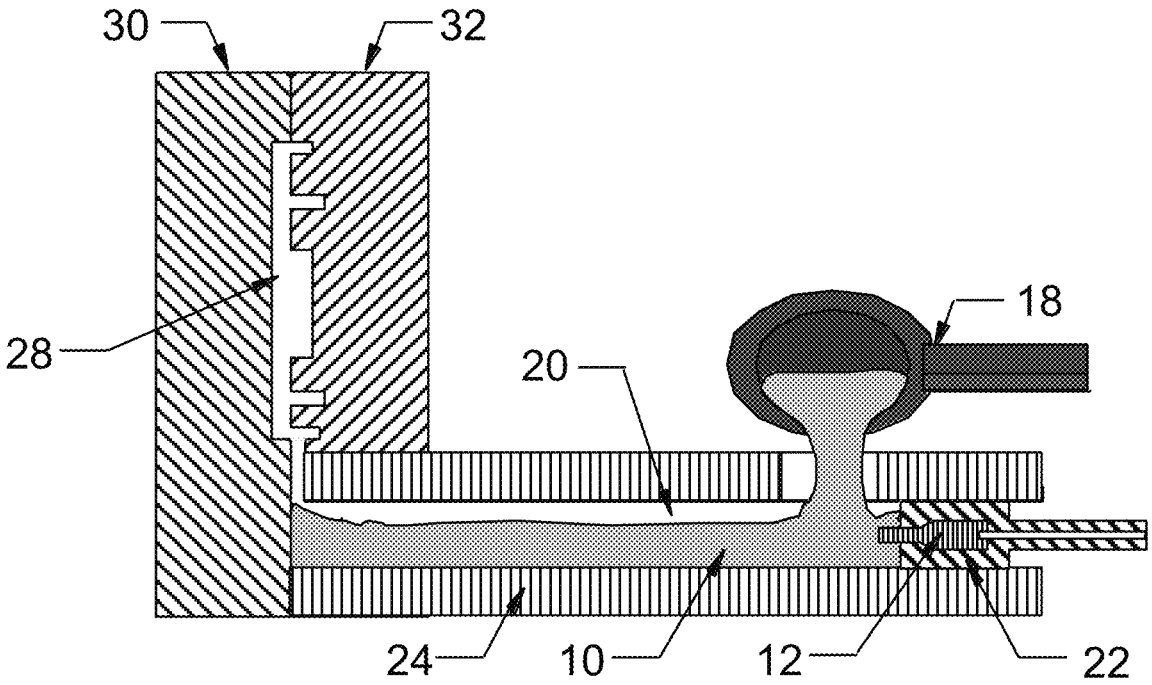
FIG. 1 schematically represents a cold chamber die casting process and a plunger coupled with high-intensity ultrasonic vibration in accordance with an embodiment of the present invention.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

In a preferred embodiment, the present invention relates to a method and apparatus for producing a slurry containing discrete non-dendritic primary phase solid particles in a shot chamber by using the high cooling capacity of the shot chamber to the molten metal and high-intensity ultrasonic vibration applied directly on to the molten metal during its early stage of solidification in the shot chamber. Here high-intensity ultrasonic vibration is defined as a type of vibration having its intensity of vibration greater than 100 $W/cm^2$ and its vibrational frequency higher than 15,000 Hz. The molten metal includes an aluminum alloy, magnesium alloy and zinc alloy.

A non-dendritic, semi-solid material is a material containing liquid material and discrete solid non-dendritic particles dispersed in the liquid material. Non-dendritic particles generally have a spherical or ellipsoidal shape. This type of particles is formed as a result of forced convection in a solidifying liquid during its nucleation and early stage of dendritic growth below the liquidus temperature of the material. The general understanding is that the forced vigorous convection breaks up dendrite arms from dendritic crystals and enhances the subsequent ripening of these fragments, turning them into spherical or ellipsoidal particles. This convective effect on the morphology of the solidifying material is pronounced during the early stage of dendritic solidification at high cooling rate when the precipitated dendrites are thin and small.

Under die casting conditions, the massive shot chamber provides rapid cooling on the liquid material to initiate its early stage of solidification. Vigorous convection occurs when pouring the liquid material into the die chamber, pushing the solidifying material by a plunger to fully fill the shot chamber, and finally injecting the solidifying material from the shot chamber to the die cavity [4]. Such a combination of rapid cooling and vigorous stirring causes certain fragmentation of dendrites formed in the shot chamber but is not sufficient to produce fully non-dendritic solid particles in the semi-solid slurry.

In a preferred embodiment, the present invention relates to a method and apparatus for producing a slurry containing discrete non-dendritic primary phase solid particles in a shot chamber. High intensity ultrasonic vibration is coupled to the plunger to assist in forming discrete non-dendritic primary phase solid particles from the molten alloy. High-intensity ultrasonic vibration can affect both the nucleation and the growth stages of dendritic solidification. With ultrasonic vibration applied to the melt, cavitations occur which give rise to the formation of a large number of tiny discontinuities or cavities. These cavities expand and collapse instantaneously, causing undercooling which leads to copious nucleation and eventual formation of the globular structures desired for semi-solid processing [5-9]. Such an acoustically induced nucleation effect is enhanced by the rapid cooling of the massive shot chamber on the molten alloy. High-intensity ultrasonic vibration is also effective in breaking up dendrites adjacent to the acoustic radiator [10]. This effect, however, decays with increasing distance from the radiator owing to acoustic attenuation in the viscous semi-solid slurry. To overcome the acoustic attenuation issue, the present invention teaches that the acoustic radiator or acoustic vibration is coupled to the tip of the plunger. As the plunger travels throughout the shot chamber and pushes the slurry towards the die cavity, the tip of the plunger encounters a large number of dendrites in the slurry. In the meantime, forced convection in the melt brings dendrites to the tip of the acoustically active plunger as well. As a result, the acoustic attenuation issue is, to a large extent, avoided, and the acoustically activated plunger can be used to process a large volume of slurry effectively.

In another preferred embodiment, the present invention relates to a method and apparatus for producing a slurry containing discrete non-dendritic primary phase solid particles in a shot chamber. High-intensity ultrasonic vibration is applied on the shot plate near the entrance to the die cavity so that the molten metal prior to entering the die cavity is processed with the acoustic radiator or the acoustically activated shot plate. High-intensity ultrasonic vibration is effective in breaking up dendrites adjacent to the acoustic radiator [10]. The dendritic fragments formed near the radiator will smooth out rapidly to form globular particles under the combined influence of acoustic streaming and vigorous turbulence caused by the plunger when the slurry is entering the die cavity.

FIG. 1 shows an ultrasound assisted cold chamber die casting process in accordance with an embodiment of this invention. An ultrasonic vibrator 12 or sonotrode 12 is coupled to a plunger 22. The sonotrode 12 is made of a ferrous alloy, a Ti alloy, a ceramic material, or a refractory metal alloy including Nb alloy, W alloy, and Mo alloy. The tip of the sonotrode 12 is made of refractory materials or coated with a layer of refractory materials which are defined as ceramics, refractory metals and their alloys including Nb, W, Mo, Ta, and Ha based alloys. Molten alloy 10 is transferred from a holding furnace or a melting furnace using a ladle 18 to a cavity 20 of shot chamber 24. As the molten metal 10 is poured into the cavity 20, ultrasonic vibration is applied to the molten metal 10 during its solidification resulted from the rapid cooling of the massive shot chamber 24. Immediately after the pouring is completed, the ultrasonic vibrator 12 and the plunger 22 push the slurry (molten metal plus dendrites that have formed) towards the end of the shot chamber 24 before entering the die cavity 28 defined by the movable die 30 and the fixed die 32. During this pushing process, high-intensity ultrasonic vibration is transmitted into the slurry to break up dendrites that form in the shot chamber and smooth them out into globular particles that are not likely to choke the mold filling at the in-gates. As a result, the molten metal 10 can be poured into a shot chamber at much lower temperatures than that using a conventional die casting process. Having a low pouring temperature is beneficial in extending die tooling life and in improving the internal integrity of the castings. Although FIG. 1 illustrates a horizontal shot chamber, the sonotrode 12 embedded plunger 22 can also be used in a vertical shot chamber in a cold chamber vertical die casting machine.

In the embodiment of this invention shown in FIG. 1, the ultrasonic vibrator 12 is coupled with the plunger 22 in a various way. For instance, the tip of the ultrasonic vibrator 12 can be protruding the tip of the plunger 22, flush with it, or lagging behind it. In the case that water cooling is applied near the tip of the plunger 22, ultrasonic vibration can be coupled through the cooling water to the tip of the plunger 22. Ultrasonic vibration can also be directly coupled to the plunger tip so that the entire tip of the plunger 22 becomes the tip of the ultrasonic vibrator 12. This means that the ultrasonic vibrator 12 and the plunger tip can be combined into one-piece.

Figure 2:
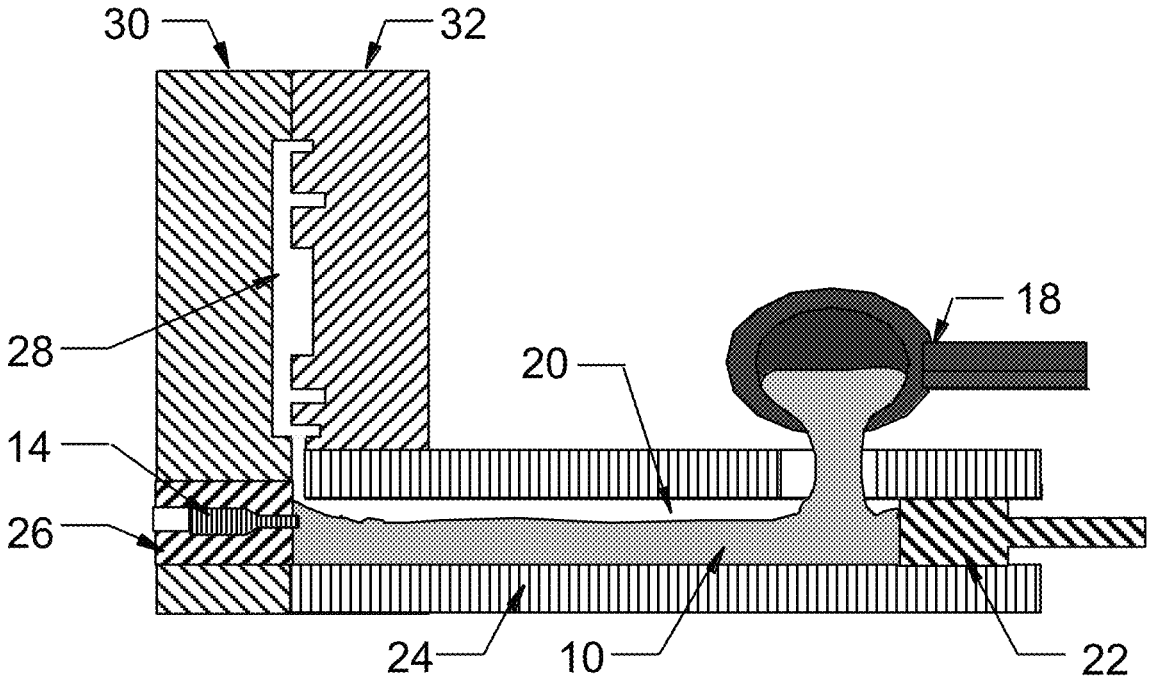
FIG. 2 schematically represents a cold chamber die casting process and a shot plate coupled with high-intensity ultrasonic vibration in accordance with another embodiment of the present invention.

FIG. 2 illustrates another ultrasound assisted cold chamber die casting process in accordance with an embodiment of this invention. An ultrasonic vibrator 14 is coupled to the shot plate 24, which is designed to rapidly solidify the biscuit, i.e., the metal remaining at the end of the shot chamber cavity 20 after the die cavity 28 is totally filled. Molten alloy 10 is transferred from a holding furnace or a melting furnace using a ladle 18 to the cavity 20 of shot chamber 24. As the molten metal 10 is pouring into the cavity 20, ultrasonic vibration is applied to the molten metal 10 during its solidification that occurs due to the rapid cooling of the massive shot chamber 24. Immediately after the pouring is completed, the molten metal 10 becomes a slurry containing liquid and dendrites that form from the liquid. The plunger 22 pushes the slurry 10 towards the shot plate 26 before entering the die cavity. During this pushing process, high-intensity ultrasonic vibration is transmitted into the slurry 10 to break up dendrites that form in the shot chamber and smooth them out into globular particles that are not likely to choke the mold filling at the in-gates [2]. Because the ultrasonic radiator 14 is placed very close to the entrance of the die cavity 28, all dendrites in the molten metal 10 in the shot chamber 24 are forced to pass by the ultrasonic radiator 14 and experience high-intensity ultrasonic vibration, resulting in the formation of non-dendritic globular solid particles in the slurry. As a result, the molten metal 10 can be poured into a shot chamber at much lower temperatures than that using a conventional die casting process. Having a low pouring temperature is beneficial in extending die tooling life and in improving the internal integrity of the castings.

In the embodiment of this invention shown in FIG. 2, an ultrasonic vibrator 14 is coupled with the shot plate 26 in a various way. For instance, the tip of the ultrasonic vibrator 12 can be protruding the tip of the shot plate 26, flush with it, or lagging behind it. In the case where water cooling is applied near the surface of the shot plate 26, ultrasonic vibration can be coupled through the cooling water to the shot plate 26. Ultrasonic vibration can also be directly coupled to the shot plate 26 so that the entire shot plate 26 becomes the ultrasonic vibrator 14.

Figure 3A:
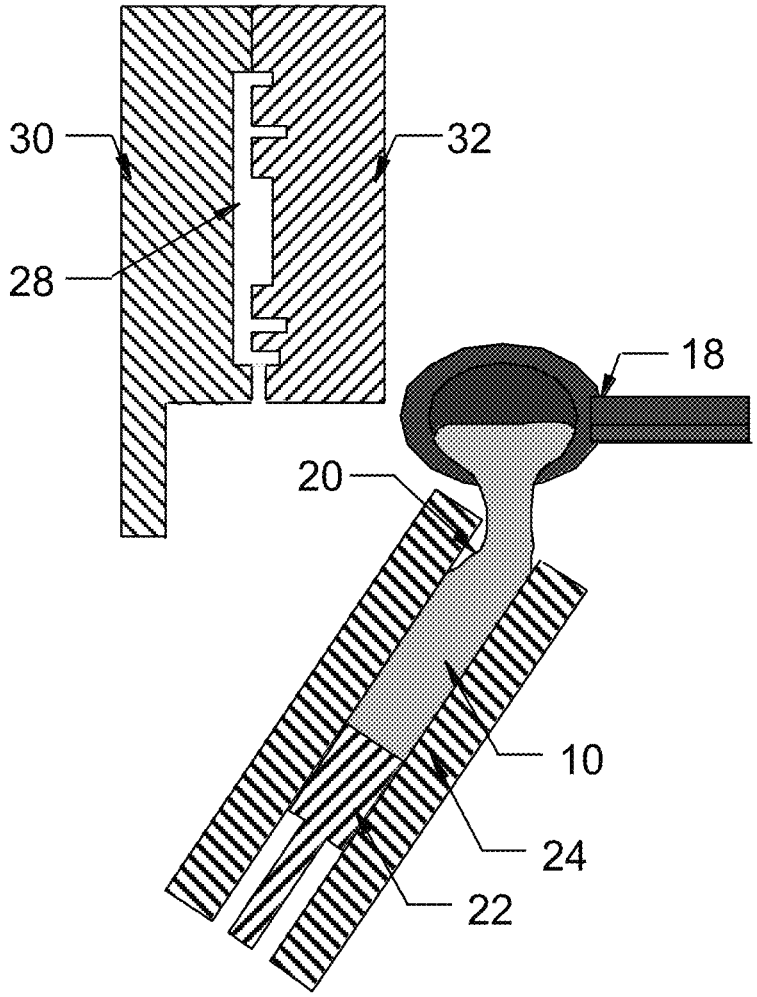
FIG. 3A schematically represents a vertical die casting process in accordance with another embodiment of the present invention.
Figure 3B:
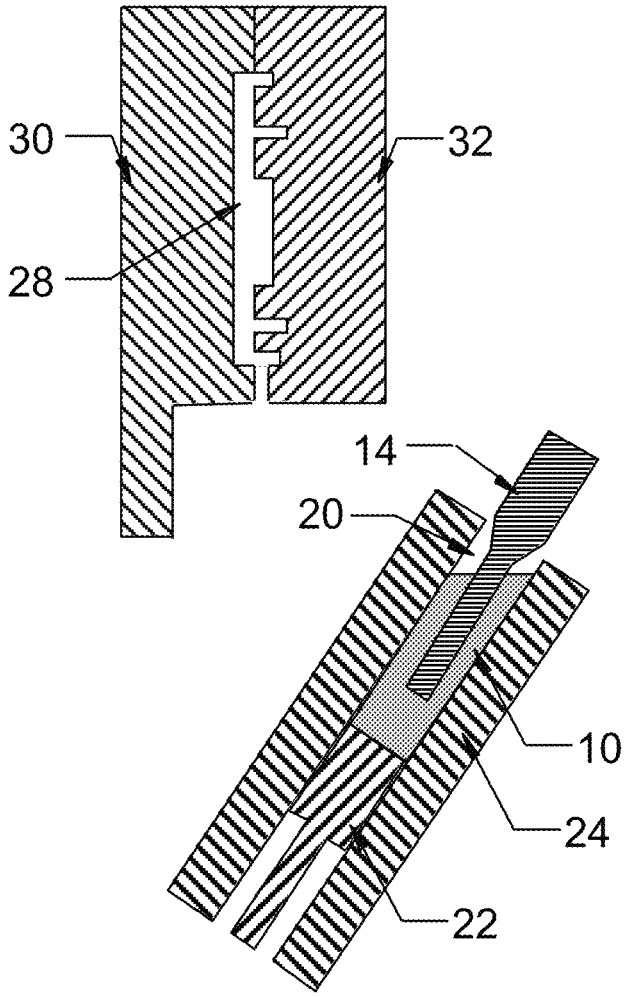
FIG. 3B schematically represents a vertical die casting process in accordance with another embodiment of the present invention.
Figure 3C:
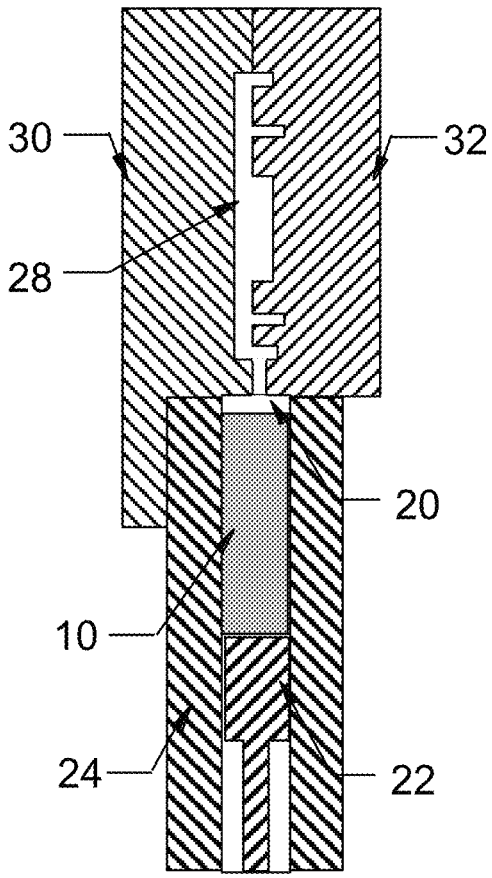
FIG. 3C schematically represents a vertical die casting process in accordance with another embodiment of the present invention.

For the vertical cold chamber die casting process, or a vertical indirect squeeze casting process, the shot chamber 24 shown in FIG. 2 is vertical and the plunger 22 is placed at the bottom of the shot chamber 24 shown in FIG. 3. The other end of the shot chamber 24 is open to receive molten metal 10 from the ladle 18 shown in FIG. 3A. After the cavity 20 in the shot chamber 24 has finished receiving the molten metal 10 shown in FIG. 3A, the sonotrode or the ultrasonic vibrator 14 is then directly submerged into the molten metal 10 within a predetermined duration and withdrawn from the molten metal. The sonotrode can also be directly submerged into the molten metal 10, lowered to the bottom of the shot chamber 24 and then withdrawn out of the shot chamber 24 within a predetermined duration to form a slurry containing a small fraction of non-dendritic fragments of dendrite shown in FIG. 3B. The shot chamber 24 is then swung back to under the dies 30 and 32 shown in FIG. 3C to allow the plunger 22 to inject the slurry 10 into the mold cavity 28 in molds 30 and 32. High-intensity ultrasonic vibration is applied through the sonotrode to the molten metal 10 while the sonotrode is in contact with the molten metal 10 in the shot chamber 24. The motion of the ultrasound-activated sonotrode in the molten metal 10 from top of the shot chamber 24 to the bottom of the shot chamber 24 as shown in FIG. 3B breaks up dendrites when the sonotrode encounters them, forming non-dendritic fragments of dendrite in the slurry 10.

Figure 4:
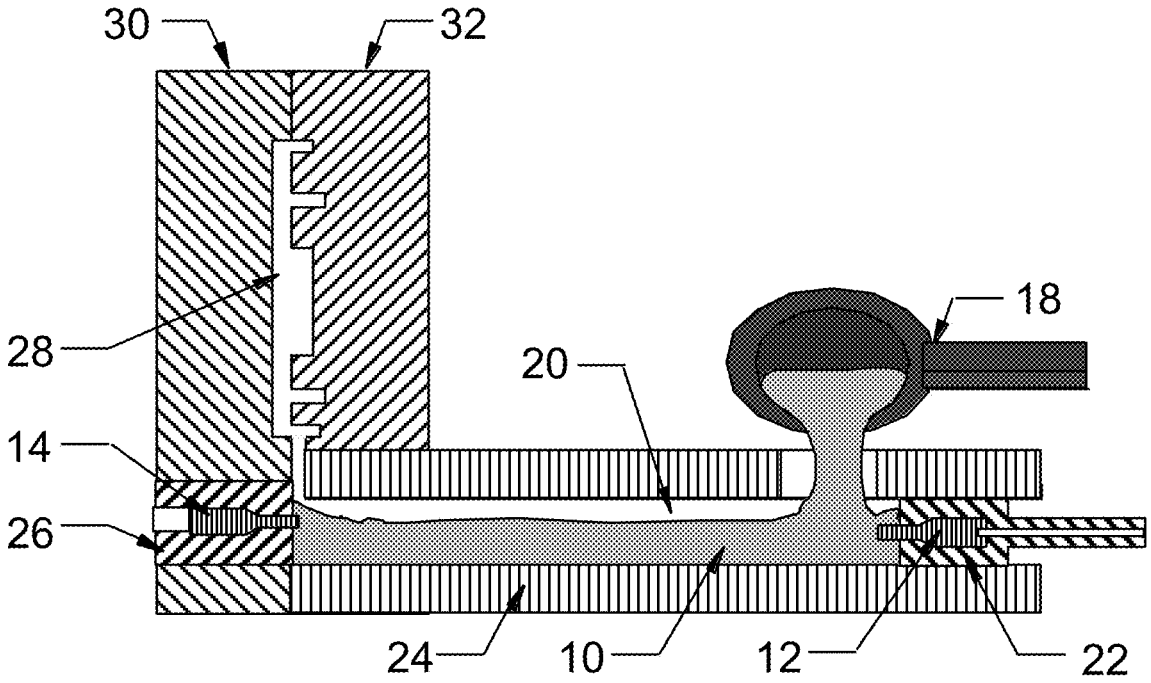
FIG. 4 represents a cold chamber die casting process with plunger and shot plate coupled with high-intensity ultrasonic vibration in accordance with the present invention.

FIG. 4 illustrates yet another ultrasound assisted cold chamber die casting process in accordance with an embodiment of this invention. The approach shown in FIG. 4 is actually a combination of the previous two approaches shown in FIG. 1 and FIG. 2. High-intensity ultrasonic vibrators, 12 and 14, are used at both of the ends of the shot chamber 24: one in the plunger 22 and the other in the shot plate 26. Molten metal 10 poured into the cavity 20 of the shot chamber 24 is subjected to high-intensity ultrasonic vibration from both ends in the shot chamber 24 as well as severe stirring due to the pushing of the plunger 22. Such a combination of ultrasound induced effects and plunger induced stirring enhances the completeness of the formation of a slurry containing liquid and spherical solid particles formed in the shot chamber, leading to an extended die tooling life and improved the internal integrity and mechanical properties of the castings made using this invention.

Figure 5:
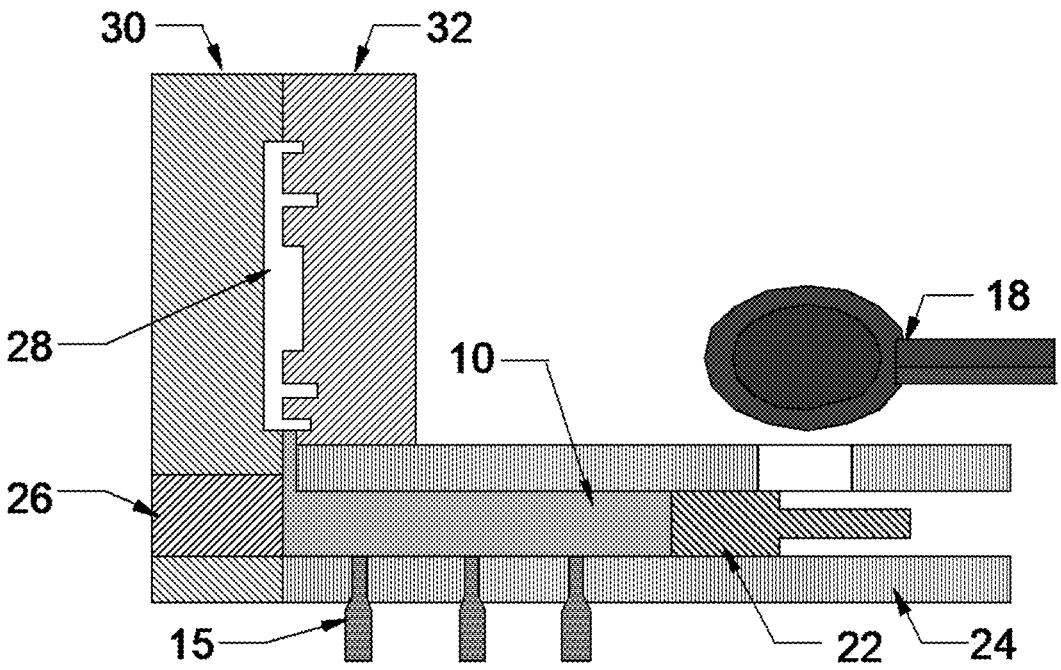
FIG. 5 represents a cold chamber die casting process with a plurality of sonotrode embedded in the tubular wall of a shot chamber in accordance with the present invention.

FIG. 5 shows an ultrasound assisted cold chamber die casting process in accordance with yet an embodiment of this invention. A plurality of an ultrasonic vibrator 15 is embedded into the tubular wall of the shot chamber 24. Molten alloy 10 is transferred from a holding furnace or a melting furnace using a ladle 18 to the cavity of shot chamber 24. As the molten metal 10 is poured into the cavity 20, ultrasonic vibration is applied directly to the molten metal 10 through the sonotrode 15 embedded in the shot chamber 24. The ultrasonic vibration energy to each sonotrode is stopped immediately before the plunger 22 passes over the sonotrode 15. The sonotrode 15 is so placed that the tip of the sonotrode contacts the molten metal 10 so that the ultrasonic vibration energy is fully transmitted to the molten metal to produce non-dendritic fragments of solid particles.

Figure 6:
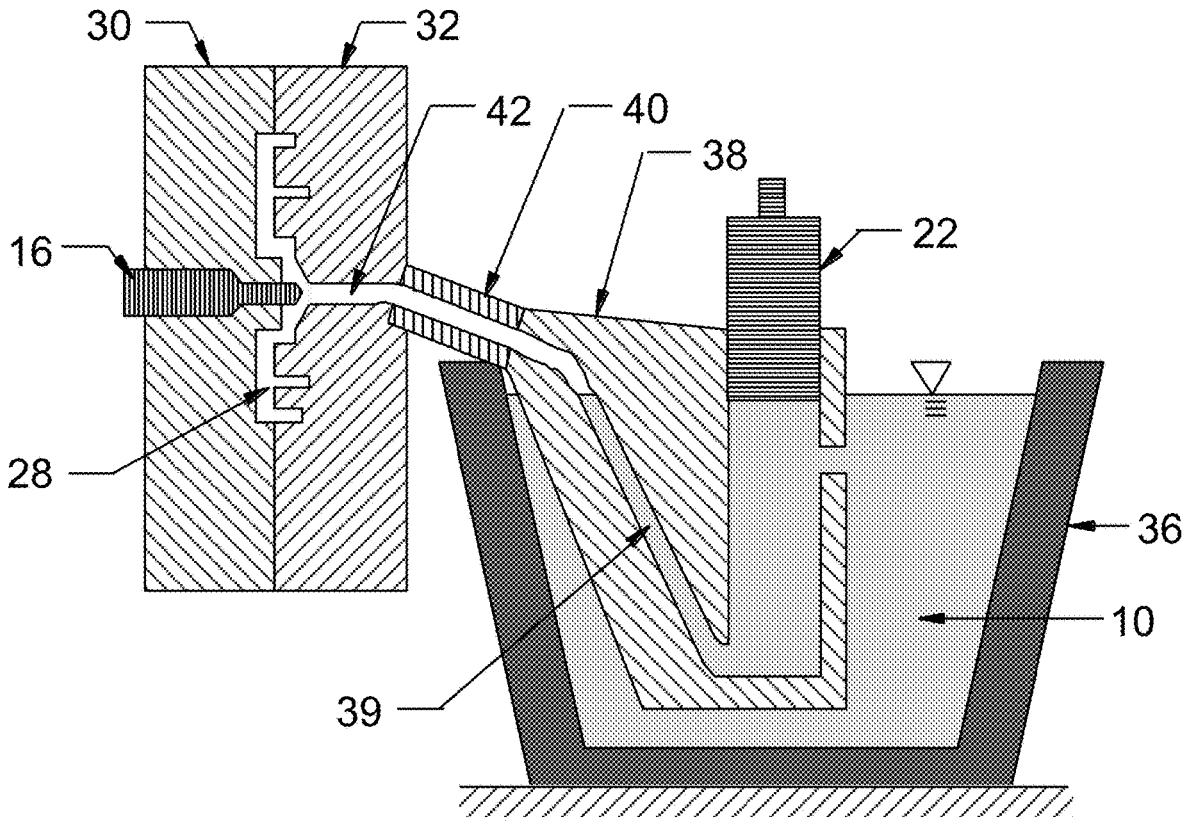
FIG. 6 represents a hot chamber die casting process and a sprue-spreader coupled with high-intensity ultrasonic vibration in accordance with the present invention.

FIG. 6 illustrates an ultrasound assisted hot chamber die casting process in accordance with an embodiment of this invention wherein an ultrasonic radiator is used as the sprue-spreader 16. As shown, molten metal 10 is held in a holding furnace 36 wherein the gooseneck 38 is partially submerged into the molten metal 10. A reciprocating plunger 22 is used to draw molten metal 10 into the cavity 39 in the gooseneck 38 and to inject the molten metal 10 from the cavity 39 through the nozzle 40 into the die cavity 28 defined by the movable die 30 and the fixed die 32. A sprue-spreader 16 is conventionally used to guide the mold filling and to freeze the metal locally so that molten metal in the mold cavity is not sucked back into the gooseneck cavity 39. This invention teaches to use an ultrasonic vibrator to replace the sprue-spreader 16 or to couple ultrasonic vibration to the sprue-spreader 16. The tip of the ultrasonic radiator faces the flow of the mold filling so that the molten metal flows pass it. Since high-intensity ultrasonic vibration is capable of breaking up dendrites in semi-solid slurry, mold filling is not likely to be choked by the formation of dendrites in the molten metal 10 in the channel 42.

The benefit of using an ultrasonic vibrator to replace the sprue-spreader 16 in FIG. 4 is that the hot chamber die casting process can be used for operation at temperatures in the molten metal that are slightly higher than the liquidus temperature of the alloy. Dendrite formation in the nozzle 40 and in the channel 42 will be less of an issue. Lower temperatures in the molten is beneficial in extending die tooling life and in improving the internal integrity of the castings. Furthermore, thermal control such as forced cooling can be used on the nozzle and the die materials near the channel 42 so that a certain small fraction of solid in the form of dendrites can be allowed to form from the molten metal. The combination of thermal management on the molten metal, the nozzle, and the die materials near the flow channel 42 may open opportunities of using the hot chamber die casting process for semi-solid material processing.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. Q. Han, and S. Viswanathan, "Analysis of the Mechanism of Die Soldering in Aluminum Die Casting," *Metallurgical and Materials Transactions A*, vol. 34A, 2006, pp. 139-46.
2. Q. Han, and J. Zhang, "Fluidity of Alloys under High Pressure Die casting Conditions—Flow Choking Mechanisms," *Metallurgical and Materials Transactions B*, vol. 33B, 2020, to be published.
3. M. C. Flemings, "Behavior of Metal Alloys in the Semisolid State," *Metallurgical Transaction B*, vol. 22B, 1991, pp. 269-93.

4. D. Sui, and Q. Han, "Effects of Different Parameters on Porosity Defects between the Horizontal and Vertical Shot Sleeve Processes," International Journal of Metalcasting, vol. 13, 2019, pp. 417-425.
5. X. Jian, H. Xu, T. T. Meek, and Q. Han, "Effect of Power Ultrasound on Solidification of Aluminum A356 Alloy," *Materials Letters*, vol. 59 (2-3), pp. 190-193.
6. O. V. Abramov, "High-Intensity Ultrasonics," Gordon & Breach Science Publishers, Amsterdam, The Netherlands, 1998, pp. 515-523.
7. G. I. Eskin, "Ultrasonic Treatment of Light Alloy Melts," Gordon & Breach Science Publishers, Amsterdam, The Netherlands, 1998, pp. 88-90.
8. Q. Han, "*Ultrasonic Processing of Materials*," Metallurgical and Materials Transactions B, vol. 46B (4), 2015, pp. 3975-3979.
9. J. D. Hunt, and K. A. Jackson, "Nucleation of Solid in an Undercooled Liquid by Cavitation," *Journal of Applied Physics*, vol. 31, 1966, pp. 254-257.
10. J. Mi, D. Tan, and T. L. Lee, "In Situ Synchrotron X-Ray Study of Ultrasound Cavitation and Its Effect on Solidification Microstructure," *Metallurgical and Materials Transactions B*, vol. 46B. 2015. pp. 1615-1619.

What is claimed is:

1. A method for producing a semi-solid material directly from its liquid material in a shot chamber in a vertical cold chamber die casting machine for making castings, comprising the steps of:

embedding at least one sonotrode in a plunger with one tip of each sonotrode in direct contact with the liquid material to be introduced in the shot chamber;

preparing the liquid material and pouring the liquid material into the shot chamber at a temperature slightly higher than its liquidus temperature;

transmitting high-intensity ultrasonic vibration through said at least one sonotrode to the liquid material immediately as the liquid material is introduced into the shot chamber wherein the tip of each sonotrode is vibrating with an intensity of ultrasonic vibration capable of creating cavitation in the liquid material nearby; and forcing slurry formed from the liquid material to fill die cavity using the plunger while high-intensity ultrasonic vibration is applied to the slurry in the shot chamber, wherein the tip of said at least one sonotrode is smaller than a tip of the plunger.

2. The method of claim 1, wherein the liquid material is poured into the shot chamber at superheat within 150° C. above its liquidus temperature.

3. The method of claim 1, wherein the at least one sonotrode is made of a ferrous alloy, a Ti alloy, a ceramic material, or a refractory metal alloy including Nb alloy, W alloy, and Mo alloy.

4. The method of claim 1, wherein the tip of the at least one sonotrode is made of refractory materials or coated with a layer of refractory materials which are defined as ceramics, refractory metals and their alloys including Nb, W, Mo, Ta, and Ha based alloys.

5. The method of claim 1, wherein the intensity of ultrasonic vibration at the tip of each sonotrode is greater than 100 $W/cm^2$ and vibrational frequency is higher than 15,000 Hz.

6. The method of claim 1, wherein the liquid material is a metallic alloy including aluminum alloys.

* * * * *